United States Patent [19]

Good

[11] Patent Number: 4,817,364

[45] Date of Patent: Apr. 4, 1989

[54] PACKAGING MACHINE AND METHOD

[75] Inventor: James L. Good, Stoneville, N.C.

[73] Assignee: Miller Brewing Company, Milwaukee, Wis.

[21] Appl. No.: 52,461

[22] Filed: May 20, 1987

[51] Int. Cl.[4] ..... B31B 1/26; B65B 7/20

[52] U.S. Cl. ..... 53/374; 53/491; 493/142

[58] Field of Search ..... 53/491, 383, 387, 374, 53/375; 493/144, 142

[56] References Cited

U.S. PATENT DOCUMENTS

| | | | |
|---|---|---|---|
| 2,351,596 | 6/1944 | Brogden et al. . | |
| 2,751,730 | 6/1956 | Gentry | 53/32 |
| 2,752,027 | 6/1956 | Gentry | 198/31 |
| 2,780,970 | 2/1957 | Gentry . | |
| 2,794,374 | 6/1957 | Gentry . | |
| 2,809,484 | 10/1957 | Gentry | 53/26 |
| 2,809,486 | 10/1957 | Gentry | 53/376 |
| 2,817,520 | 12/1957 | Gentry | 271/32 |
| 2,826,409 | 3/1958 | Gentry | 271/44 |
| 2,831,681 | 4/1958 | Gentry | 271/61 |
| 2,850,953 | 9/1958 | Barker et al. . | |
| 2,933,867 | 4/1960 | Gentry | 53/29 |
| 2,933,870 | 4/1960 | Gentry | 53/209 |
| 2,936,560 | 5/1960 | Gentry | 53/219 |
| 2,953,883 | 9/1960 | Gentry | 53/209 |
| 2,974,461 | 3/1961 | Demler | 53/383 X |
| 2,981,042 | 4/1961 | Gentry | 53/157 |
| 2,996,169 | 8/1961 | Gentry | 198/162 |
| 3,002,329 | 10/1961 | Cookson et al. | 53/375 |
| 3,014,415 | 12/1961 | Pierce . | |
| 3,032,942 | 5/1962 | Gentry | 53/26 |
| 3,130,527 | 4/1964 | Wood | 53/48 |
| 3,187,483 | 6/1965 | Steele et al. | 53/383 X |
| 3,485,008 | 12/1969 | Silver | 53/374 X |
| 3,733,772 | 5/1973 | Dichiara | 53/167 |
| 3,777,448 | 12/1973 | Howe | 53/375 X |
| 4,519,181 | 5/1985 | Sherman et al. | 53/374 |
| 4,562,687 | 1/1986 | Green, Jr. | 53/383 |
| 4,633,655 | 1/1987 | Nigrelli, Sr. | 53/343 |

*Primary Examiner*—James F. Coan
*Attorney, Agent, or Firm*—Quarles & Brady

[57] ABSTRACT

An improved package machine includes a vertically adjustable compression belt for maintaining the top of a carton flat while forces which might cause the top to bow upwardly are being exerted on the end flaps to hold them in contact until an adhesive takes hold.

1 Claim, 2 Drawing Sheets

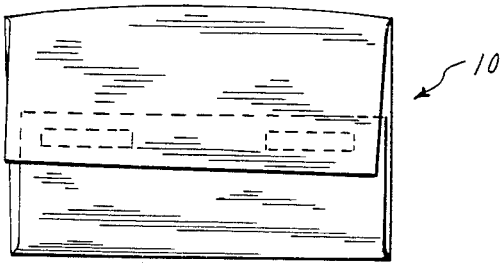
FIG. 1
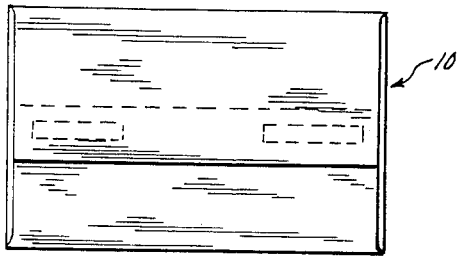
FIG. 2
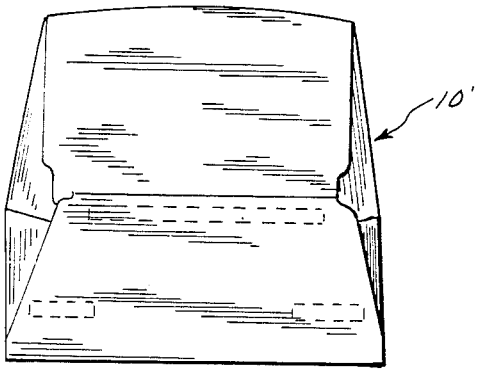
FIG. 3
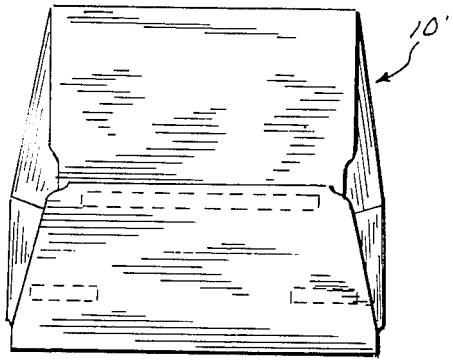
FIG. 4
FIG. 5
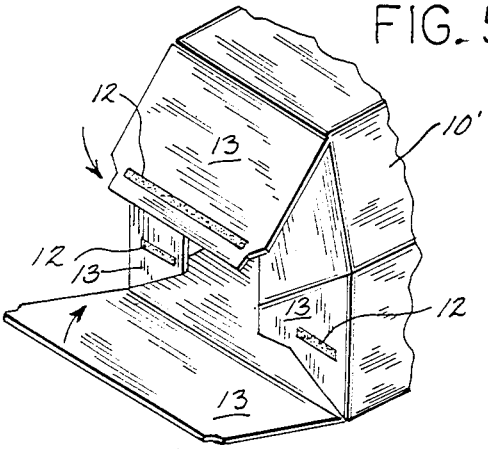
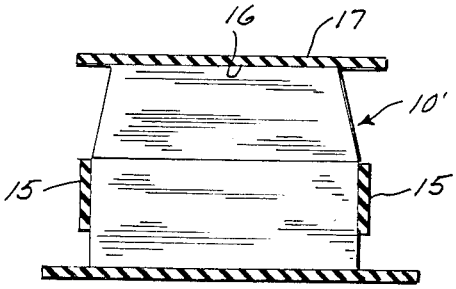
FIG. 9
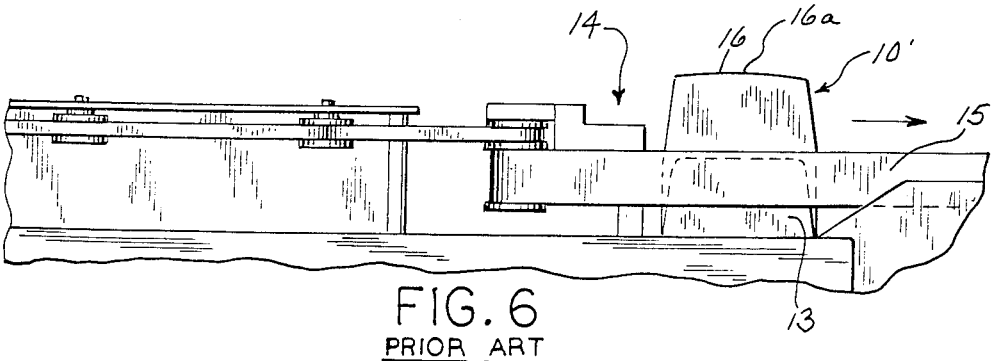
FIG. 6
PRIOR ART FIG. 7
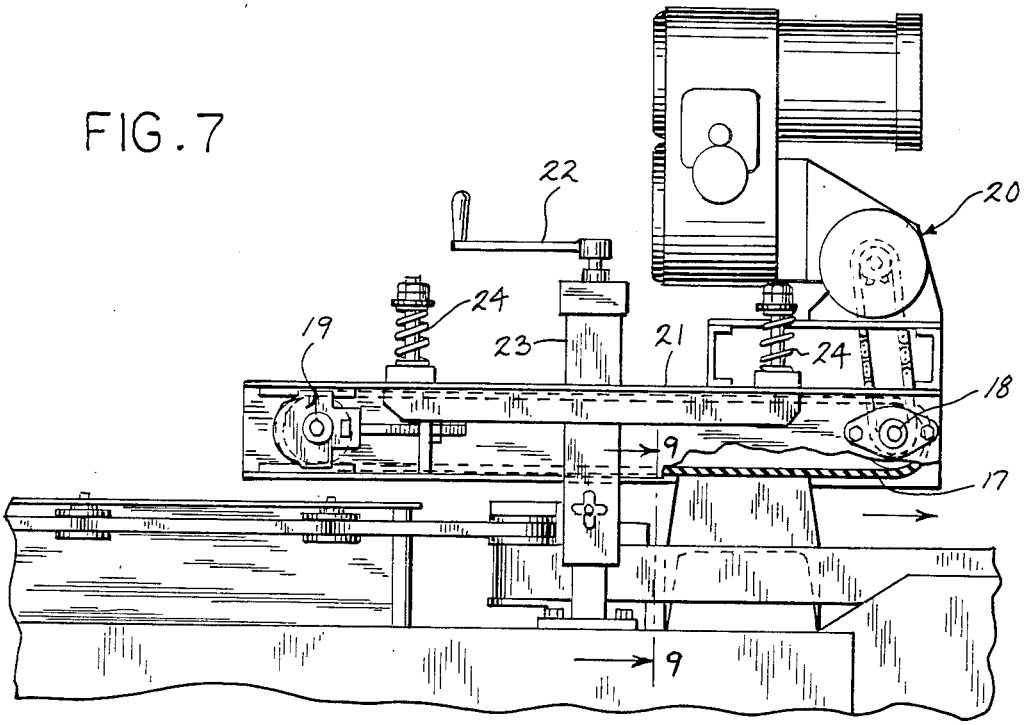
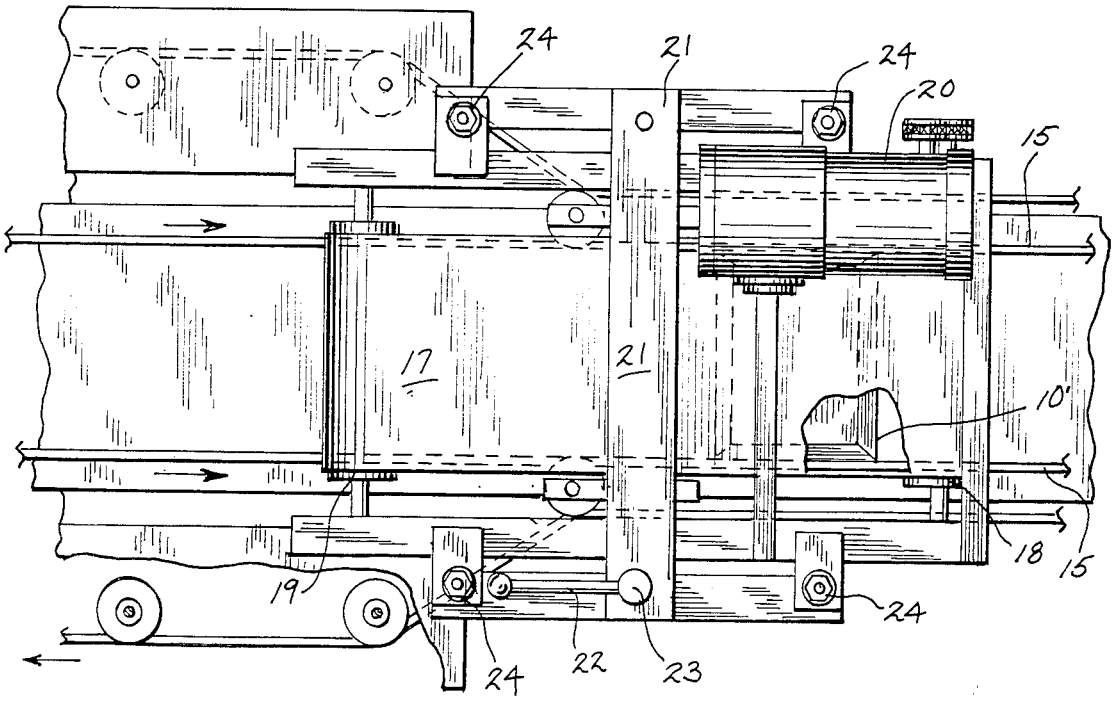
FIG. 8

PACKAGING MACHINE AND METHOD

FIELD OF THE INVENTION

The present invention relates to an improved packaging machine and method. More particularly, it relates to an improved method and machine for sealing cartons containing a plurality of articles, such as cans or bottles of beer or soft drinks, in a sleeve type carton.

BACKGROUND OF THE INVENTION

A number of different machines exist for erecting cartons, loading the cartons with a plurality of objects, and folding and sealing the end flaps of the cartons to form the completed package. Such machines are used extensively in the brewing and soft drink industries to package cans or bottles in six or twelve packs.

One recurring problem with such machines, especially when they are operated at higher speeds, is the tendency for the final packages to be formed out of square with the end flaps not properly aligned with each other and the sides of the cartons. In addition to presenting appearance problems, this improper alignment also can present handling and storage problems. For example, when the end flaps project beyond the sidewalls of the carton, they can catch on other packages and objects or even tear.

SUMMARY OF THE PRESENT INVENTION

The primary objects of the present invention are to disclose an improved method and machine to eliminate the problem of improperly aligned and flaps on cartons.

I have discovered that the problem of misaligned end flaps on finished cartons can be eliminated if the top of a carton is maintained substantially flat while sealing forces are exerted on the side end flaps. In the commonly used packaging machine, forces are normally exerted on the side walls (e.g. by side bars) and on the bottom (by gravity) but no corresponding force is exerted on the top of the carton. As a result the top of the carton may bow upwardly, especially when the machine is running at high speeds, causing the end flaps to be misaligned and sealed in such position.

I have discovered that the most advantageous method of solving the long standing problem of misaligned end flaps in the commonly used packaging machines is to maintain the top of the carton flat while forces which might cause the top to bow upwardly are being exerted on the side end flaps to hold the end flaps in contact until an adhesive takes hold. I also have discovered that the preferred means for keeping the top of the carton flat is a vertically adjustable compression belt that contacts the top of the carton and moves in the same direction as the carton at about the same speed. The force exerted by the compression belt on the top of the carton needs to be only enough to compensate for the distortion caused by the forces on the side end flaps of the carton.

It will be apparent from the description which follows that the primary object and other advantages can be achieved.

BRIEF DESCRIPTION OF THE DRAWINGS

In the drawings:

FIG. 1 is an end view of one type of a carton with the end flaps misaligned;

FIG. 2 is a similar view of the carton of FIG. 1 with the end flaps properly aligned;

FIG. 3 is an end view of another type of carton with the end flaps misaligned;

FIG. 4 is an end view of the carton of FIG. 3 with the end flaps properly aligned;

FIG. 5 is a view showing the relationship of the end flaps of a carton of FIG. 3 prior to sealing;

FIG. 6 is a partial side view of the end flap sealing section of a prior art packaging machine;

FIG. 7 is a partial side view of the end flap sealing section of a conventional packaging machine with the improvement of the present invention in place;

FIG. 8 is a top view of the machine of FIG. 7; and

FIG. 9 is a view taken along line 9—9 in FIG. 7.

DESCRIPTION OF PREFERRED EMBODIMENT

In the preferred embodiment of the invention, the end flap sealing section of a packaging machine is provided with a vertically adjustable compression belt for maintaining the top of the carton flat during sealing and preventing forces applied to the side end flaps of the carton from causing the top of the carton to bow upwardly and the end flaps to be sealed in misalignment.

Referring to the drawings, in FIGS. 1 and 3, there can be seen cartons 10 and 10', respectively, in which the end flaps are improperly aligned. In contrast, in FIGS. 2 and 4 cartons 10 and 10', respectively, are shown in which the end flaps are properly aligned. FIG. 5 is a view of the unsealed end of a carton 10' of FIGS. 3 and 4 showing the pressure sensitive adhesive strips 12 which seal the end of the carton 10' when the end flaps 13 are moved in the direction of the arrows and held in contact with the adhesive strips 12 long enough for the adhesive to take hold.

In FIG. 6 the carton sealing section of a prior art machine of the type commonly employed is shown. A representative machine is described in U.S. Pat. No. 3,733,772, which is incorporated by reference herein. The sealing section of the machine 14 essentially comprises a surface, such as a conveyor, upon which cartons 10' travel in the direction indicated by the arrow. The carton erecting, loading and unloading sections of the machine are not shown, however, they may, of course, take many forms.

As seen in FIG. 6, in the sealing section proper, one of a pair of wide horizontal compression belts 16 presses the bottom end flap 13 (seen in dotted lines) against the pressure sensitive adhesive strips 12 (not seen) on the side end flaps and top end flap. As seen only in FIG. 6 the forces exerted on the sides by the belts 15 can cause the top 16 of the carton 10' to bow up as at 16 and result in the end flaps being misaligned as seen in FIGS. 1 and 3.

In FIGS. 7 and 8, a packaging machine similar to that of FIG. 6 is seen except that the sealing section is provided with the improvement of the present invention. As seen therein, a vertically adjustable compression belt 17 is seen supported above the top surface of the machine. The vertical compression belt is wrapped about a drive roller 18 and an idler roller 19 and it is driven by a power source generally referred to by the numeral 20. The belt 18 is supported by a frame 21 which can be moved up and down by turning a crank 22 attached to a jack screw 23. The frame 21 supporting the compression belt 17 is yieldably urged downward by four compression springs 24 which permit the belt to automatically rise or fall to adjust to minor differences in carton height.

In use, the vertical compression belt 17 is first raised or lowered by turning the crank 22 of the jack screw 23 until the belt 17 is the right height to contact the top of a carton 10'. When the belt is thus positioned it will exert sufficient downward force on the top of the carton 10' to compensate for any distorting forces, and maintain the top 18 flat so that the carton 10' is kept square while the horizontal compression belts 15 are forcing the end flaps 13 into sealing contact with the pressure sensitive areas. In FIG. 9 can be seen the cross-sectional shape of the carton 10' when the vertical compression belt 17 is properly adjusted.

It will be readily apparent to those skilled in the art, that a number of modifications and changes can be made without departing from the spirit and scope of the present invention. Therefore, it is intended that the invention not be limited except by the claims.

I claim:

1. In a packaging machine for packaging a plurality of articles in cartons having irregular side walls, a flat top and vertical end flaps to be sealed, the improvement which comprises a vertically adjustable compression belt which is supported by springs and which rises and falls automatically to adjust to mirror variations in carton height; said belt adapted to maintain pressure upon the center of the top of a carton to keep the top flat while the end flaps are being sealed so that the end flaps will be properly aligned.

* * * * *